United States Patent [19]

Iwami et al.

[11] 4,165,165

[45] Aug. 21, 1979

[54] COLOR IMAGE FORMATION APPARATUS

[75] Inventors: Naoki Iwami, Tokyo; Hidejiro Kadowaki, Yokohama; Takao Aoki, Abiko; Shunichi Kubo, Tokyo; Akihiro Tomosada, Yokohama; Tetsuji Tachika, Tokyo; Eiichi Kondo, Kawasaki, all of Japan

[73] Assignee: Canon Kabushiki Kaisha, Tokyo, Japan

[21] Appl. No.: 766,681

[22] Filed: Feb. 8, 1977

[30] Foreign Application Priority Data

Feb. 12, 1976 [JP] Japan ..... 51/14274

[51] Int. Cl.[2] ..... G03G 15/01

[52] U.S. Cl. ..... 355/4; 355/14; 355/71

[58] Field of Search ..... 355/3 R, 4, 14, 67, 355/70, 71

[56] References Cited

U.S. PATENT DOCUMENTS

| | | | |
|---|---|---|---|
| 3,313,623 | 4/1967 | Bixby | 355/4 X |
| 3,936,182 | 2/1976 | Sheikh | 355/4 X |
| 3,960,445 | 6/1976 | Drawe | 355/4 |
| 3,987,756 | 10/1976 | Katayama et al. | 355/4 X |
| 4,008,962 | 2/1977 | Nepper | 355/4 X |

FOREIGN PATENT DOCUMENTS

| | | | |
|---|---|---|---|
| 2459108 | 6/1975 | Fed. Rep. of Germany | 355/4 |

*Primary Examiner*—Fred L. Braun

*Attorney, Agent, or Firm*—Fitzpatrick, Cella, Harper & Scinto

[57] ABSTRACT

In a color image formation apparatus which comprises a photosensitive medium, optical image exposure device for exposing the photosensitive medium to an optical image having light components of an image original, and electrostatic latent image formation device for forming electrostatic latent images on the photosensitive medium in accordance with the exposure to the optical image. The image formation apparatus includes a color separating device having a plurality of color separating filters disposed along the optical path of the optical image exposure device, a developing device having a plurality of developing units for supplying different color developers to develop the electrostatic latent images formed on the photosensitive medium by the electrostatic latent image formation device, a mode setting element for designating the combination of one of the color separating filters and one of the developing units, and a control device for reading the combination of a predetermined color separating filter and a predetermined color developing unit designated by the mode setting device and for causing the designated color separating filter and the designated color developing unit to cooperate with each other.

21 Claims, 17 Drawing Figures

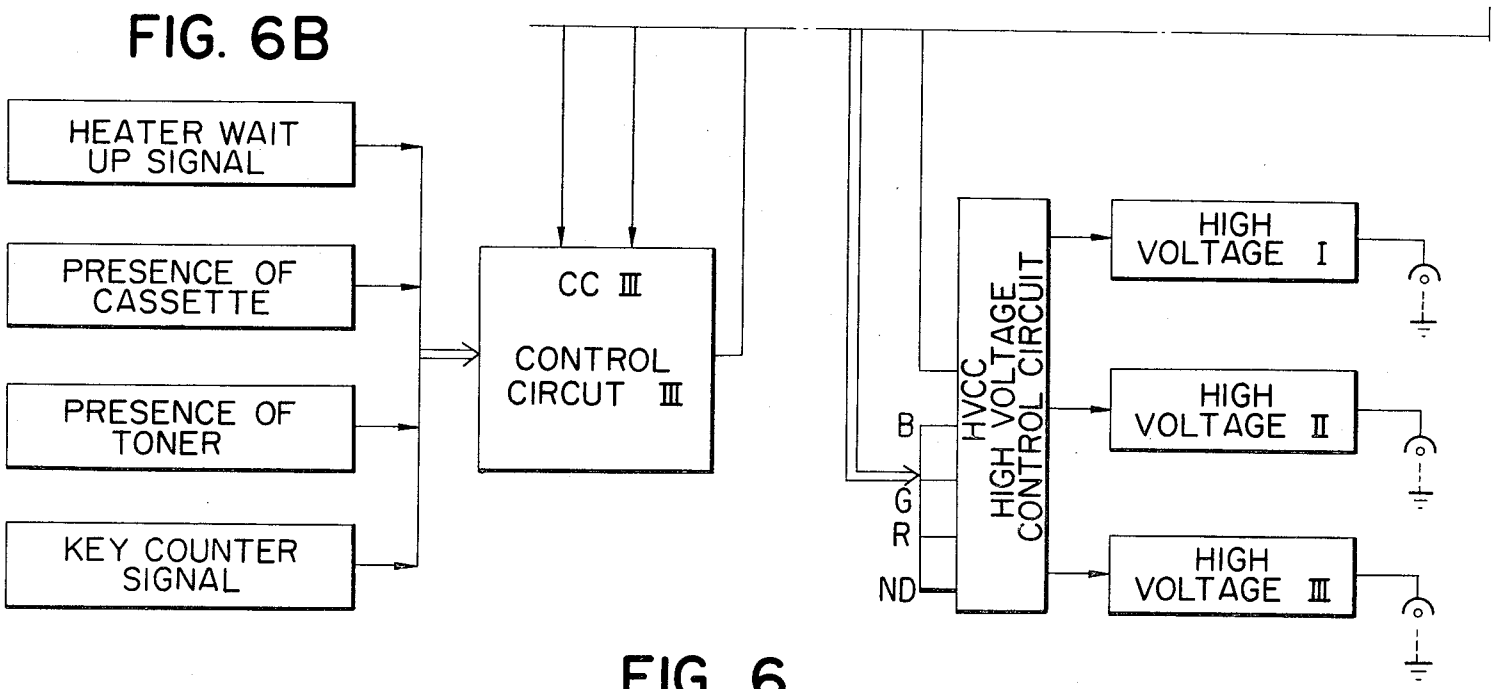
FIG. 6B
FIG. 6
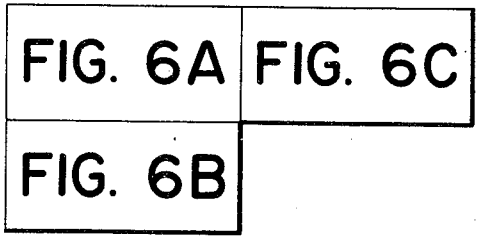

COLOR
BK-M
R
G
B
Y
M
C
BK
D0
D1
D2
A1
A2
A3
A4
A5
A6
A7
A8
A9
A10
A11
A12
A13
A14
A15
A16
A17
A18
A19
A20
A21
A22
F1
F2
F3
F4
E1
E2
E3
E4
B
G
R
N
Y
M
C
BK

PRIMARY CHARGER
AC DISCHARGER
AC 100V
HVT-1
HVT-2
R13
R14
R15
R16
R17
R18
R19
R20
R21
R22
R23
R24
R25
R26
R27
R28
R29
R30
R31
R32
R33
R34
R35
SY-1
SY-2
SY-3
SM-1
SM-2
SM-3
SC-1
SC-2
SC-3
SN-1
SN-2
SN-3
R9
R10
R11
R12
TRC-B
TRC-G
TRC-R
TRC-N
UJT-B
PT-B
UJT-G
PT-G
UJT-R
PT-R
UJT-N
PT-N
Vcc
R5
R6
R1
R2
R3
R4
C1
C2
C3
C4
Vcc(B)
Vcc(G)
Vcc(R)
Vcc(N)

COLOR IMAGE FORMATION APPARATUS

BACKGROUND OF THE INVENTION

1. Field of the Invention

This invention relates to a color image formation apparatus which enables multicolor reproduction of image originals, and more particularly to a color image formation apparatus which enables the faithful multicolor reproduction of image originals in any desired combination of colors.

2. Description of the Prior Art

Color copying apparatus based on the electrophotographic system have heretofore been proposed and put into practice to produce color copies of image originals. Some of these apparatuses have had the functions of performing the full color reproduction, namely, forming electrostatic latent images comprising separated color images—red (R), green (G) and blue (B)—of an image original and developing these latent images by the use of color developers, namely, cyan (C), magenta (M) and yellow (Y), to realize three-color reproduction, and the function of developing the electrostatic latent images corresponding to the image original by the use of respective ones of the color developers to achieve respective color reproductions.

However, the materials to be copied by the office copiers often include typewritten originals bearing red underlines or red entries and there has been a great demand for the simplified reproduction of such originals, whereas the conventional copiers have involved the full color reproducing process in achieving black reproduction of such originals and if used to copy such originals, these copiers have been seriously time-consuming and costly.

There has also been much desire for apparatuses which cannot only achieve faithful color reproduction of originals but also can be simply operated by average users to enable image originals having any color components to be copied in any desired color, whereas the conventional apparatuses have had no such versatility.

SUMMARY AND OBJECTS OF THE INVENTION

It is an object of the present invention to provide a color image formation apparatus which enables any desired color reproduction of image originals.

It is another object of the present invention to provide a versatile color image formation apparatus which can achieve various color reproductions meeting the various clerical purposes in offices or the like.

It is another object of the present invention to provide a color image formation apparatus which enables laymen or average users to obtain color reproductions in any desired combination of colors.

Generally described, the apparatus of the present invention is characterized by color separating means having four different filters, namely, red, green, blue and ND filters, for color-separating an image original, developing means having a plurality of developing units for supplying four different developers, namely, cyan, magenta, yellow and black developers, a plurality of mode setting elements for setting different combinations of predetermined color separating filters of said color separating means and predetermined color developing units of said developing means, and a plurality of sets of mode separating means for setting a predetermined number of sets of predetermined ones of said mode setting elements.

The invention will become more fully apparent from the following detailed description thereof taken in conjunction with the accompanying drawings.

BRIEF DESCRIPTION OF THE DRAWINGS

FIG. 6 illustrates the relative positions of FIGS. 6A–C.

FIGS. 6A–C together form a block diagram illustrating the control system for the apparatus shown in FIG. 1.

DESCRIPTION OF THE PREFERRED EMBODIMENTS

Figure 1:
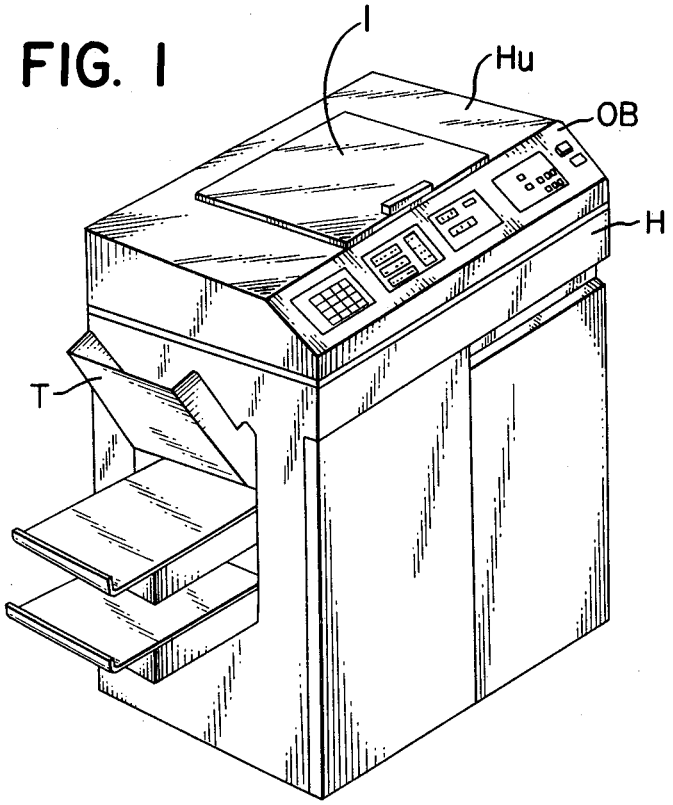
FIG. 1 is a perspective view of an embodiment of the apparatus according to the present invention.

FIG. 1 shows, in perspective view, the electrophotographic color copying apparatus according to an embodiment of the present invention, which includes a housing H and a carriage 1 disposed on the upper surface Hu of the housing H for carrying thereon an original to be copied. At this side of the upper surface Hu, as viewed in FIG. 1, there is provided an operating board OB, on which are arranged a main switch, copy switch, copy number selector, cassette selector and operating switches for setting various color modes. The operating switches for setting various color modes will later be described in connection with FIGS. 3 to 5.

The operating switches shown in FIG. 3 (hereinafter referred to as the copy mode switches) serve to readily select and set combinations of reproducing colors.

The operating switches shown in FIG. 4 (hereinafter referred to as the color programming switches) serve to select various combinations of the reproducing colors and color separating filters.

The operating switches shown in FIG. 5 (hereinafter referred to as the color balance switches) serve to set combinations of the reproducing colors and color separating filters and the sequence of operations of these filters, as well as to select and set the density of reproduction.

Figure 2:
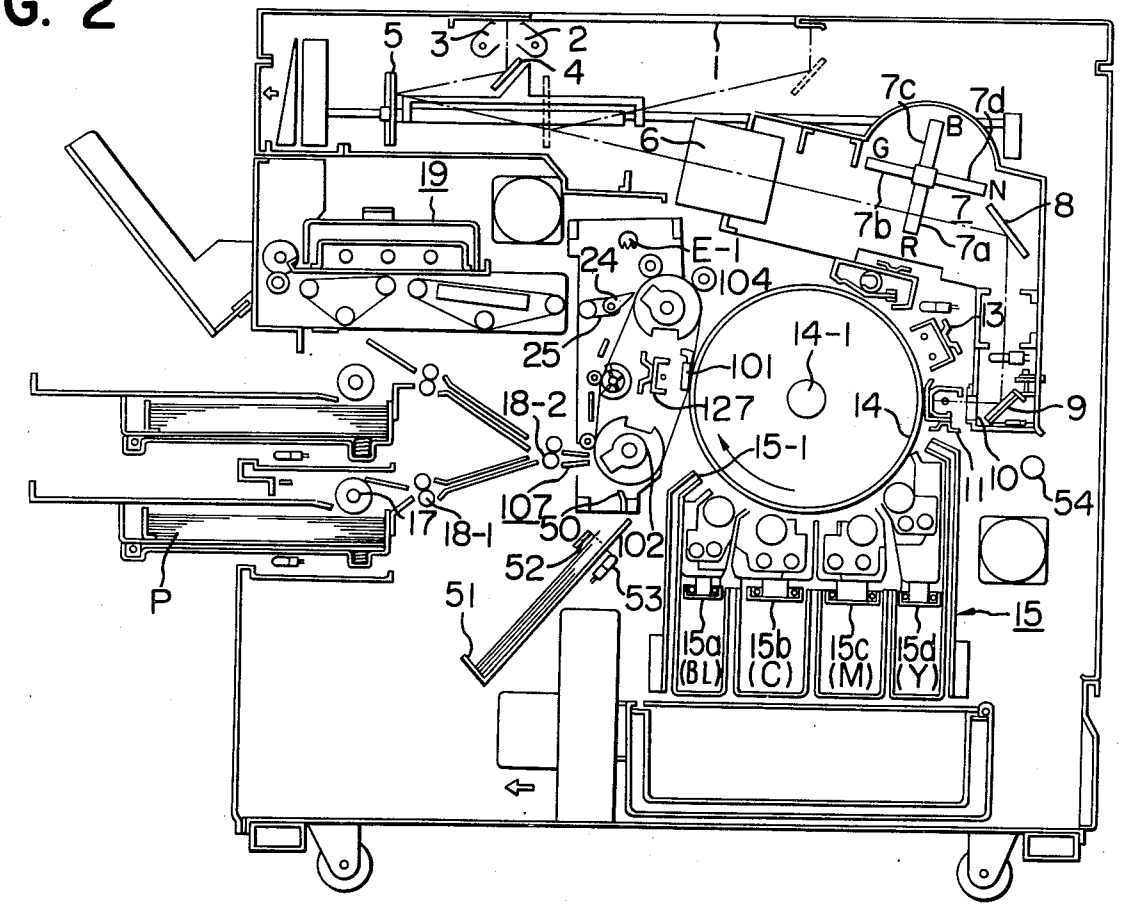
FIG. 2 is a front sectional view of the same apparatus.

FIG. 2 is a front sectional view of the apparatus shown in FIG. 1.

Operation of this electrophotographic color copying apparatus will hereinafter be described with respect to the case of full color copying. The original on the original carriage glass 1 is illuminated by an illumination system (comprising a halogen lamp 3 and a reflector 2) which is integrally formed with a first scanning mirror 4, and the reflected light from the original is scanned by the first scanning mirror 4 and by a second scanning mirror 5. The first and the second scanning mirror are moved at the velocity ratio of 1:½, thereby scanning the original while keeping the first half of the optical path length of a lens system 6 constant at all times. The reflected image light passes through the lens 6 to color separating filter means 7, where the light is color-separated by a predetermined one of filters *7a, 7b, 7c* and *7d* of the filter means corresponding to three colors, red (R), green (G) and blue (B) and ND, and the color-separated image light is passed via a third mirror 8 and a fourth mirror 9 and through a dust-proof sealing glass 10 and focused on a photosensitive drum 14. The photosensitive drum 14 is rotatably supported on a shaft $14_1$. The surface of the photosensitive drum has attached thereto a three-layer photosensitive plate comprising an insulative layer such as polyester film, a panchromatic photoconductive layer formed of powdered CdS or like photoconductor dispersed in resin, and a conductive layer such as aluminum foil.

Upon operation of print button, the photosensitive drum is started to rotate in the direction of arrow and electrostatically charged (e.g. to the positive polarity) by a primary charger 13 supplied with a predetermined polarity of voltage, whereafter it is subjected to application of the color-separated image light while being discharged by a discharger 11 of AC or supplied with the opposite polarity of voltage (e.g. negative), and then the photosensitive drum is uniformly illuminated by an allover exposure lamp 54 to form an electrostatic latent image with high contrast.

The electrostatic latent image on the photosensitive drum 14 is then developed into a visible image by a developing device 15. The developing device 15 comprises four developing units 15*a*, 15*b*, 15*c* and 15*d* for black (BK), cyan (C), magenta (M) and yellow (Y), is designed such that a developing unit corresponding to a color separating filter (for example, the yellow developing unit 15*d* for the blue filter 7*c*) is operated to effect development. A sheet of transfer paper P is fed from a cassette into the apparatus by a paper feed roller 17 and given a first timing by timing rollers 18-1 and given a further accurate timing by timing rollers 18-2, whereafter the transfer paper is transported into an opening formed by a gripper 101. The gripper 101 provides the opening with the aid of the action of a cam 102 and closes the opening when the paper has come to a position off the cam 102, thereby gripping the paper at the leading edge thereof. Subsequently, the developed image on the photosensitive drum 14 is transferred onto the transfer paper P as it passes between a transfer corona charger 127 and the photosensitive drum 14. In case of the full color copying, the cam 102 is kept so as not to act on the gripper 101, so that the gripper makes three complete rotations while gripping the transfer paper P. In the meantime, the above-described image formation step is carried out with the filter and developing unit interchanged, to permit three color images, namely, the yellow toner image resulting from the blue filter exposure, the magenta toner image resulting from the green filter exposure and the cyan toner image resulting from the red filter exposure, to be sequentially superposed upon one another on the same transfer paper. Thereafter, a separating pawl 24 and the gripper actuating cam 104 are operated to liberate the transfer paper from the gripper onto a conveyor belt 25. Subsequently, the transfer paper is heated and fixed by a heat-fixing device 19 and discharged outwardly of the apparatus.

Where single-color or two-color development is to be effected in this apparatus, it will be obvious that the step of latent image transfer similar to that in each color image formation during the full color reproduction is carried out by the use of a combination of a predetermined filter and a predetermined developing color.

Figure 6A:
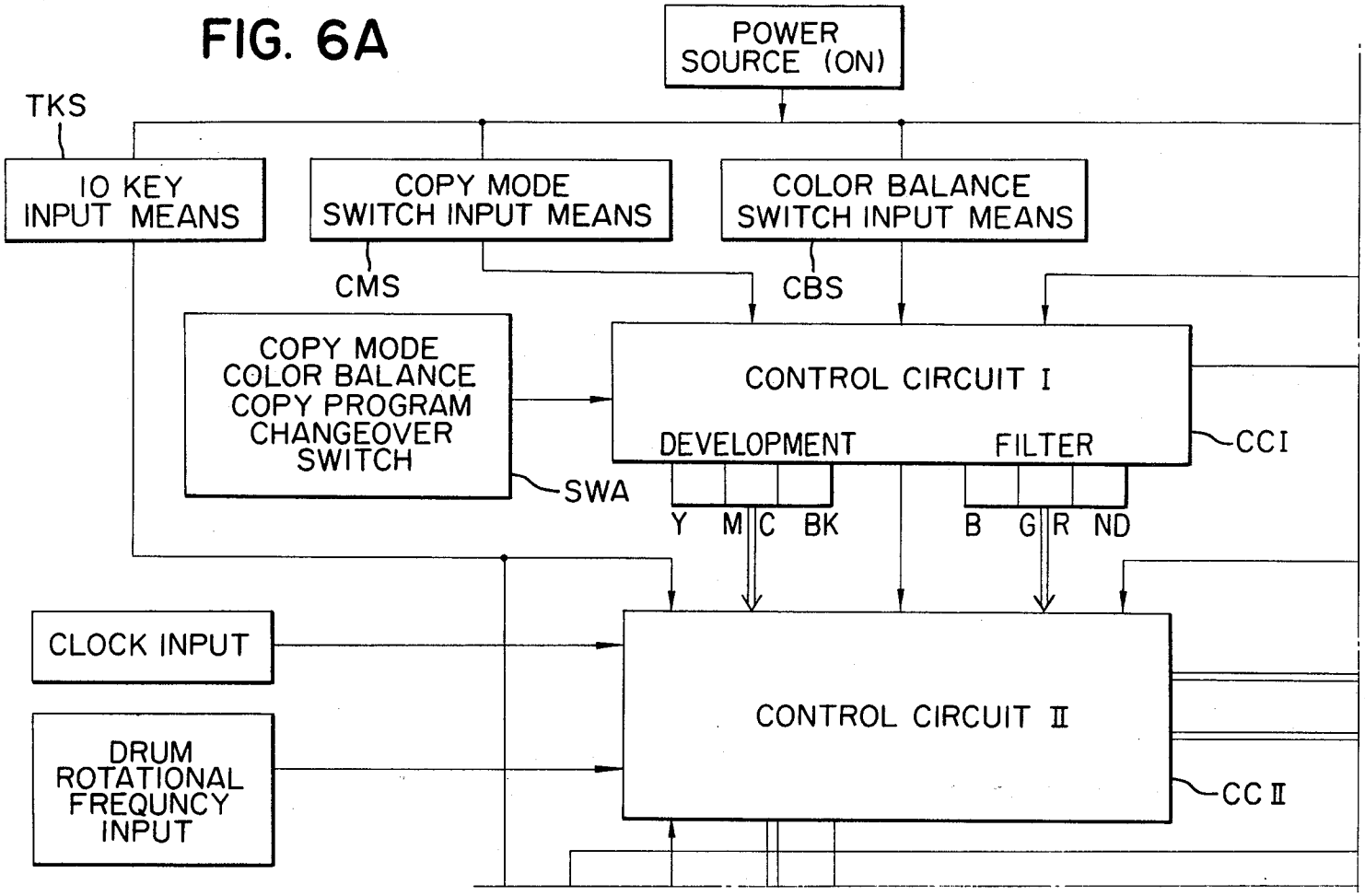
Figure 6C:
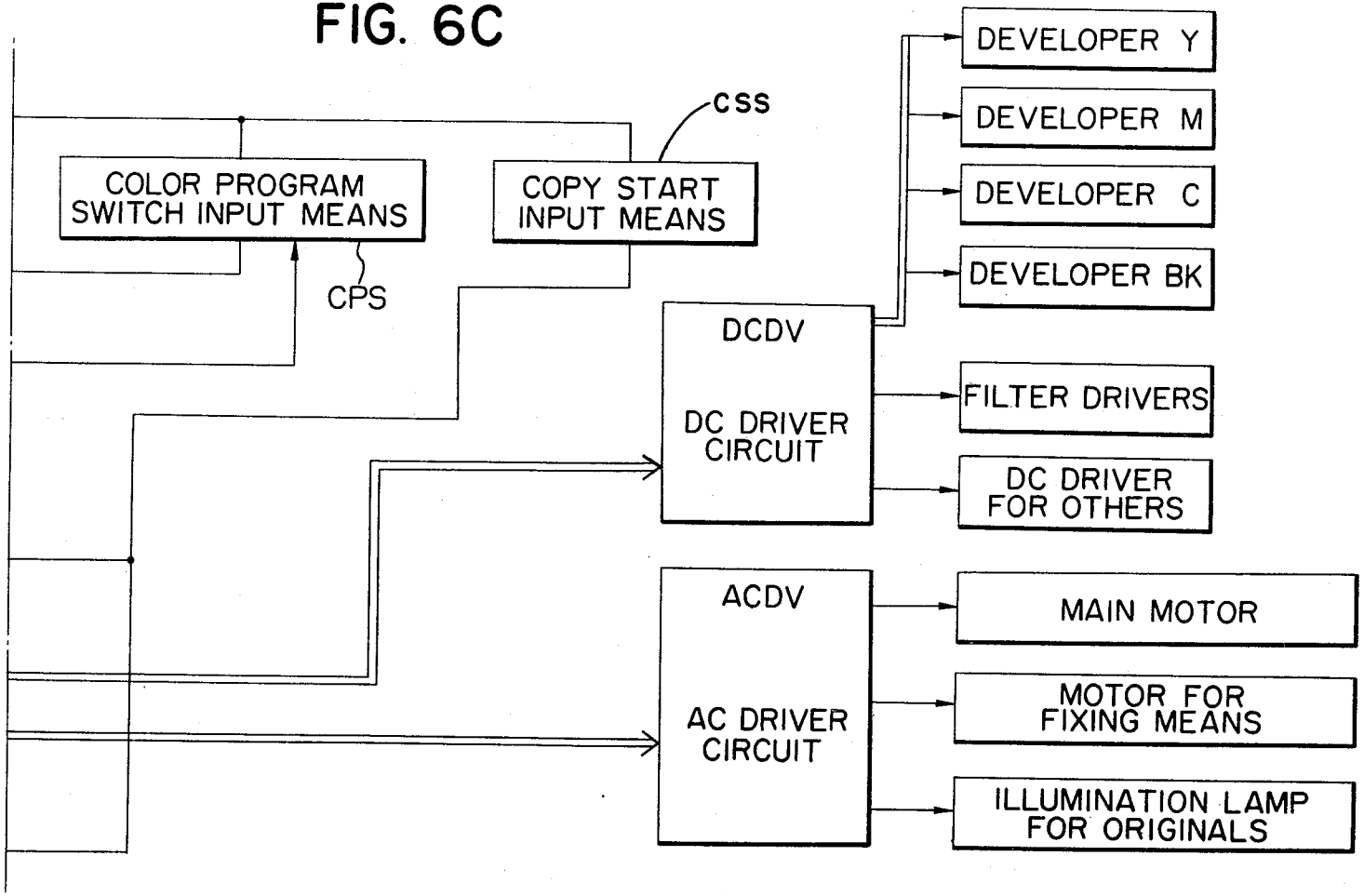

FIGS. 6 A–C form a block diagram illustrating the control system in the apparatus of the present invention now under discussion.

Figure 4:
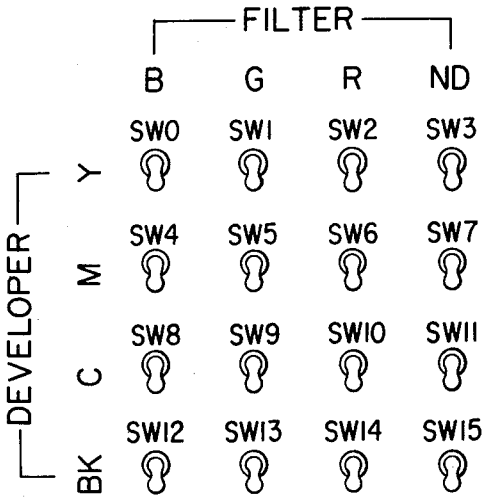
FIGS. 3 to 5 are partial view showing programming switches on the operating panel of the apparatus shown in FIG. 1.
Figure 3:
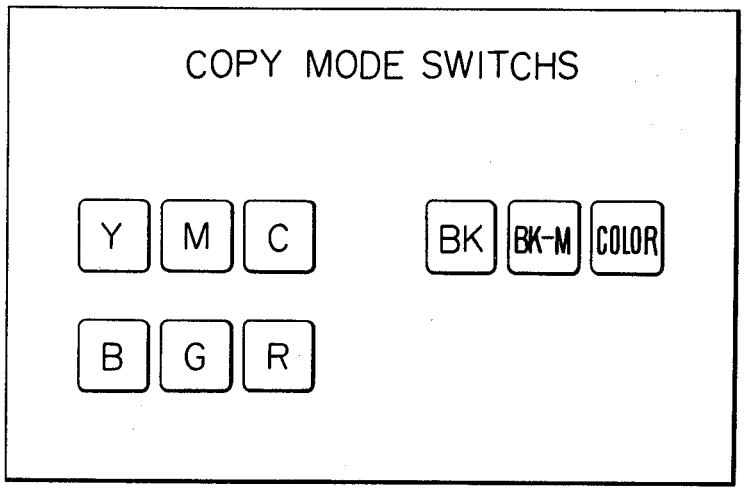
Figure 5:
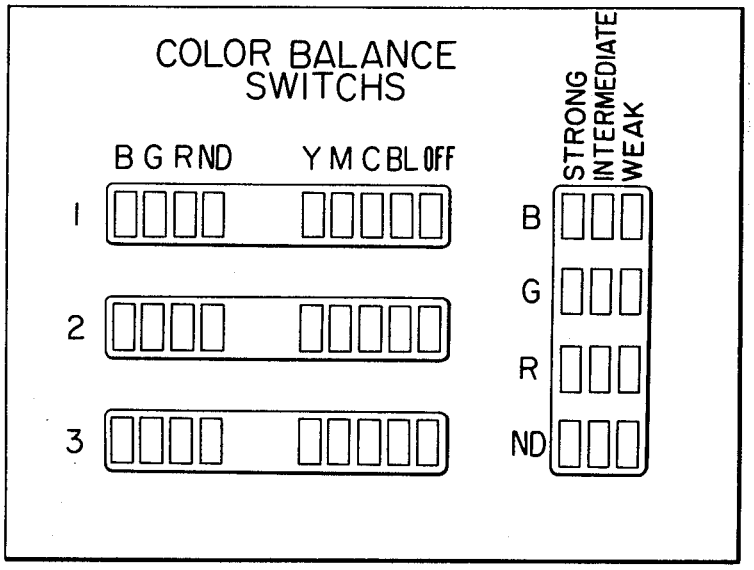

A control circuit I (CCI) to which the operator's instructions are chiefly applied is connected to a copy mode switch input means (CMS), a color programming switch input means (CPS) and a color balance switch input means (CBS) shown in FIGS. 3 to 5, and also receives the input signal from a switch SWA which is a change-over switch between said switch input means. On the other hand, a 10-key input switch (TKS) for instructing the number of copies and a copy start switch or input means (CSS) are connected to a control circuit II (CCII) for controlling the copying operation.

The condition of each process means required to start the copying operation within the copying apparatus is also shown. Signals such as heater warm-up signal (HWS), cassette paper presence signal (CDS), toner presence signal (TDS), key counter signal (KCS), etc. are connected and applied to a control circuit III (CCIII).

The control circuit I (CCI) judges whether the colors of the original to be reproduced are three or two or one, and the type of the development and the type of the filter during each scanning are put out as output signals therefrom and delivered to the control circuit II (CCII). Also, when the conditions for copying are prepared in the control circuit III (CCIII), the output signal therefrom is delivered to the control circuit II (CCII). The control circuit II (CCII), which receives the input signals from the control circuits I and III to effect copying, determines the timing of operation of each load in accordance with the combination of the input of the clock signal from the photosensitive drum and the input of the number of revolutions of the drum, and the output signal from the control circuit II drives each load through DC driver (DCDV) and AC driver (ACDV). The loads driven through the DC driver (DCDV) are chiefly the developing units Y, M, C and BK for supplying distinct color developers and the filter drive for interchanging the filters. The loads driven through the AC driver (ACDV) are chiefly the main motor for driving the photosensitive drum, the motor for driving the fixing device and the lamp for illuminating the original. Further, a high voltage control circuit (HVCC) is operated with the timing as determined by the control circuit II to energize the high voltage I for the primary charging, the voltage II for simultaneous application of the image light and discharge, and the voltage III for image transfer.

Each of the operating switches on the operating board OB will now be described.

(I) Copy Mode Switches:

The copy mode switches shown in FIG. 3 are used to select the modes of full color copying, single color copying and two-color copying, and more particularly, the switch COLOR is for the full color reproduction, the switch BK-M is for the two-color reproduction in black and magenta, and the switches R, G, B, BK, C, M and Y are for the reproduction of red, green, blue, black, cyan, magenta and yellow images, respectively. In the present embodiment, however, three kinds of developer, namely, cyan, magenta and yellow are used so that red, green and blue may be represented by a mixture of these, that is, red may be represented by a mixture of magenta and yellow, green by a mixture of cyan and yellow, and blue by a mixture of cyan and magenta, but red, green and blue developers may of course be employed.

Combinations of filters and developing units during various color modes will now be shown.

Table 1

| No. | Copy Mode Switch | Frequency of Superposed Transfer | Filter-Developing unit | Reproducing Color |
|---|---|---|---|---|
| 1 | Y | 1 | ND - Y | Y |
| 2 | M | 1 | ND - M | M |
| 3 | C | 1 | ND - C | C |
| 4 | BK | 1 | ND - BK | BK |
| 5 | B | 2 | ND - M<br>ND - C | B |
| 6 | G | 2 | ND - Y<br>ND - C | G |
| 7 | R | 2 | ND - Y<br>ND - M | R |
| 8 | BK - M | 2 | G - M<br>R - BK | BK - M |
| 9 | Color | 3 | B - Y<br>G - M<br>R - C | Full Color |

In the table above, the filter designated by ND refers to:

(1) ND filter;

(2) ND filter having superposed thereon a color-temperature combination filter of cyan, yellow or other color; and (3) Absence of the filter, namely, the condition equivalent to that of a monochromatic copying machine; and it is identical in meaning to what is expressed as ND or ND filter in the present specification.

Among the above-mentioned copy mode switches, the single color reproducing mode (Nos. 1 to 7 in Table 1) is most suitable for use to obtain differently colored copies from, for example, a slip or other identical original.

In the apparatus of the present embodiment, copies in each of seven colors can be accomplished by respective ones of the developing processes shown in Table 1 and in this case, completely monochromatic reproduction of an original can be realized by using the ND filter without selecting any complementary color filter, instead of selecting a filter for the developing color as is usually done in the case of color reproduction.

The two-color reproducing mode (No. 8 in Table 1), namely, the black-magenta reproduction is best suited for copying of such an original as a certificate bearing a seal or stamp or an original bearing red characters or red underlines in addition to black characters, and such reproduction is useful to call the attention of the final user of the copy and accordingly, very effective to carry out the office work.

The two-color reproduction is not restricted to the combination with magenta, but combination with any other color than magenta may of course be used. However, red, green or blue, whose reproduction is effected by a mixture of two color developers in the apparatus of the present embodiment, means the necessity of using an additional color for the image formation and this inconveniently leads to an increased copying time. In this sense, combination with cyan, magenta or yellow developer is more effective in connection with the construction of the apparatus.

The switches for these combinations may of course be provided as desired.

The three-color reproduction mode (No. 9 in Table 1) is indispensable to the full-color reproduction, and may more effectively be made into a process having added thereto the black color development.

On the other hand, the factors for an electrostatic latent image to be formed on the photosensitive medium may be set in accordance with the filters selected, that is, the voltage applied for the primary charging and for the discharging simultaneous with the application of the image light and/or the optimum quantity of exposure may be set in accordance with the filters determined for use.

Effectively, the factors for the primary charging and the discharging simultaneous with the application of the image light should be set by controlling the output voltage of the high voltage source by means of an electric circuit and the factors for the quantity of exposure should be set by automatically varying the aperture of the lens by the use of a servomotor or superposing a suitable ND filter upon the filter portion so as to preset an optimum quantity of exposure for each filter.

The developing units may be provided with automatic developer supply means so that optimum developing conditions may be imparted to respective developer, thereby controlling the developing capacities of the developers individually. As the result, any average user can produce color copies of good quality without fail and with a simple operation.

Figure 7B:
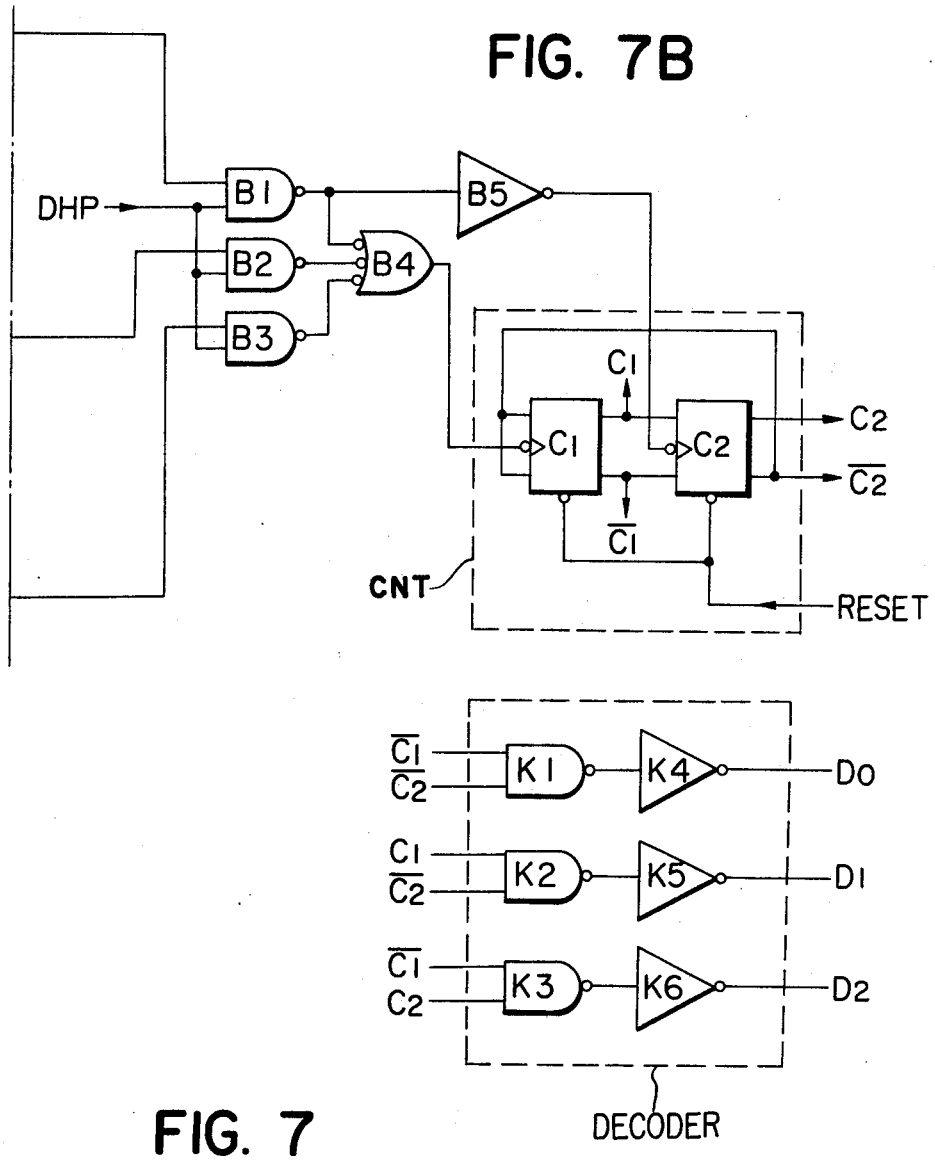
FIG. 7 illustrates the relative positions of FIGS. 7A and 7B.
FIGS. 7A and B diagrammatically show an example of the control circuit based on the switches shown in FIG. 3.
Figure 7:
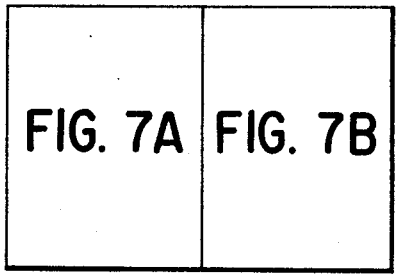
Figure 7A:
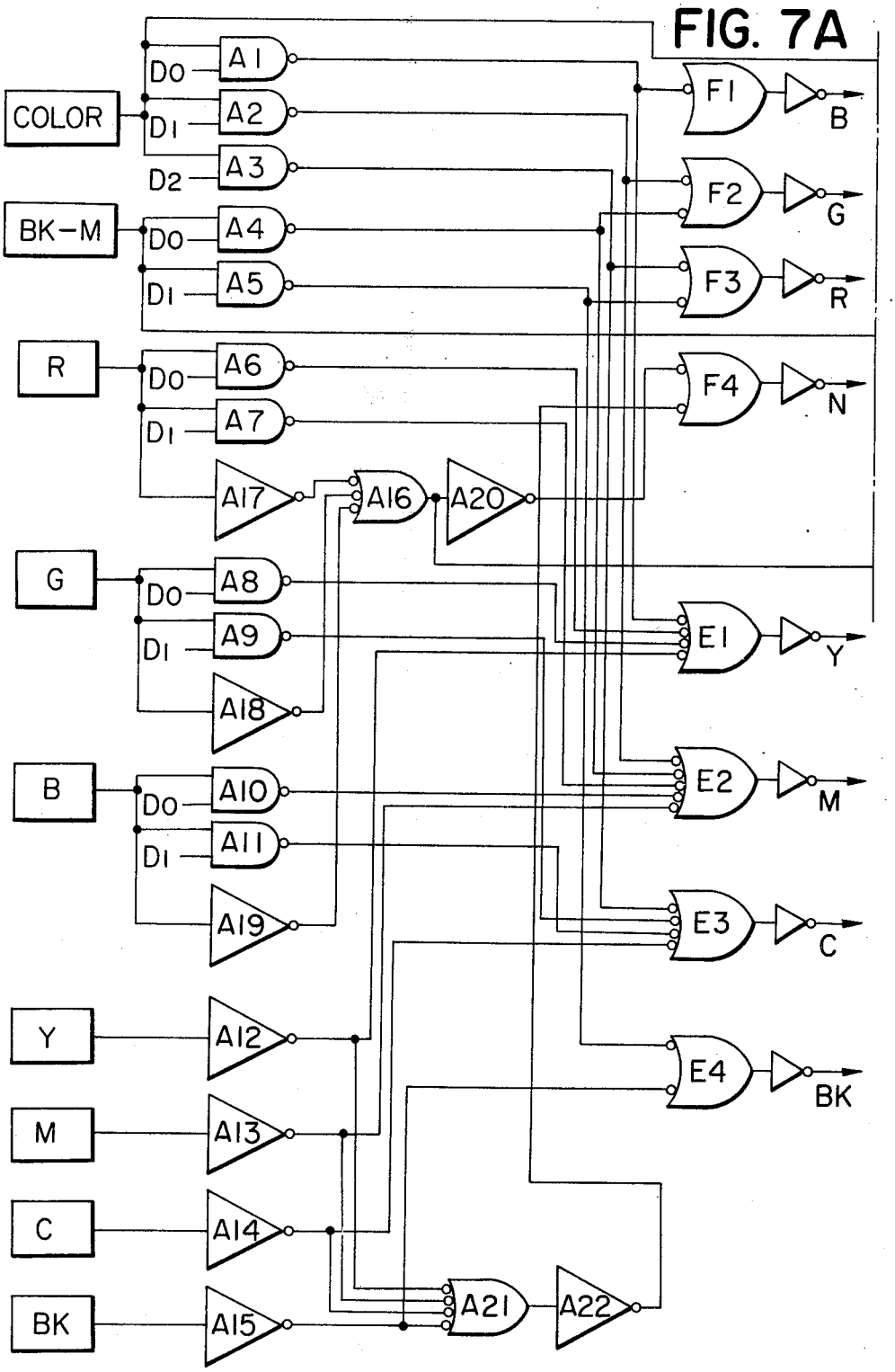

FIGS. 7 A and B show a form of the circuit for driving the filters and the developing units in accordance with the selection of such copy mode switches. The circuit will hereinafter be described by reference to FIGS. 7 A and B.

The copy mode switches, namely, the switches COLOR, BK-M, R, G, B, Y, M, C and BK are connected to gates $A_1$–$A_{15}$ corresponding to the numbers of the images formed during the respective modes, which gates are in turn connected to the filters to be controlled $F_1$–$F_4$ and to gates $E_1$–$E_4$ for designating the developing units to be used, so that by one of the switches being set, the combination of the filter and developing unit corresponding to that switch may be designated.

On the other hand, the copying operation is started by drum home position signal DHP which is generated upon detection of the transfer drum or the like being at a predetermined position, and such signal is utilized to control the opening-closing of each gate.

Particularly, in case of the full color reproduction and in case of the BK-M or the R-G-B reproduction, the drum home position signal DHP is applied as input to a counter CNT in order to effect the image reproducing process three times and two times, respectively, so that the opening-closing of each of the gates concerned with the respective modes may be controlled in accordance with the count by the counter.

More specifically, the home position signal DHP (FIG. 7B) (which assumes H-level in the home position of the drum and L-level during the other times) opens the gate $B_1$ when the COLOR switch is depressed, and then passes through the gates $B_4$ and $B_5$ to provide the clock input for the flip-flops $C_1$ and $C_2$ of the counter CNT. At this time, the counter CNT performs as a trinary counter and generates signals $D_0$, $D_1$ and $D_2$ in succession through a decoder DEC. In case of BK-M or R, G, B, the gate $B_2$ or $B_3$ is opened and the home position signal DHP passes through the gate $B_4$ to provide the clock input for the flip-flop $C_1$ of the counter CNT. This time, the counter CNT performs as a binary counter and generates signals $D_0$ and $D_1$ through the decoder DEC. On the other hand, in case of single color reproduction, the home position signal DHP is not applied to the counter CNT but directly applied as input signal to each of the gates $A_{12}$–$A_{15}$.

Figure 8:
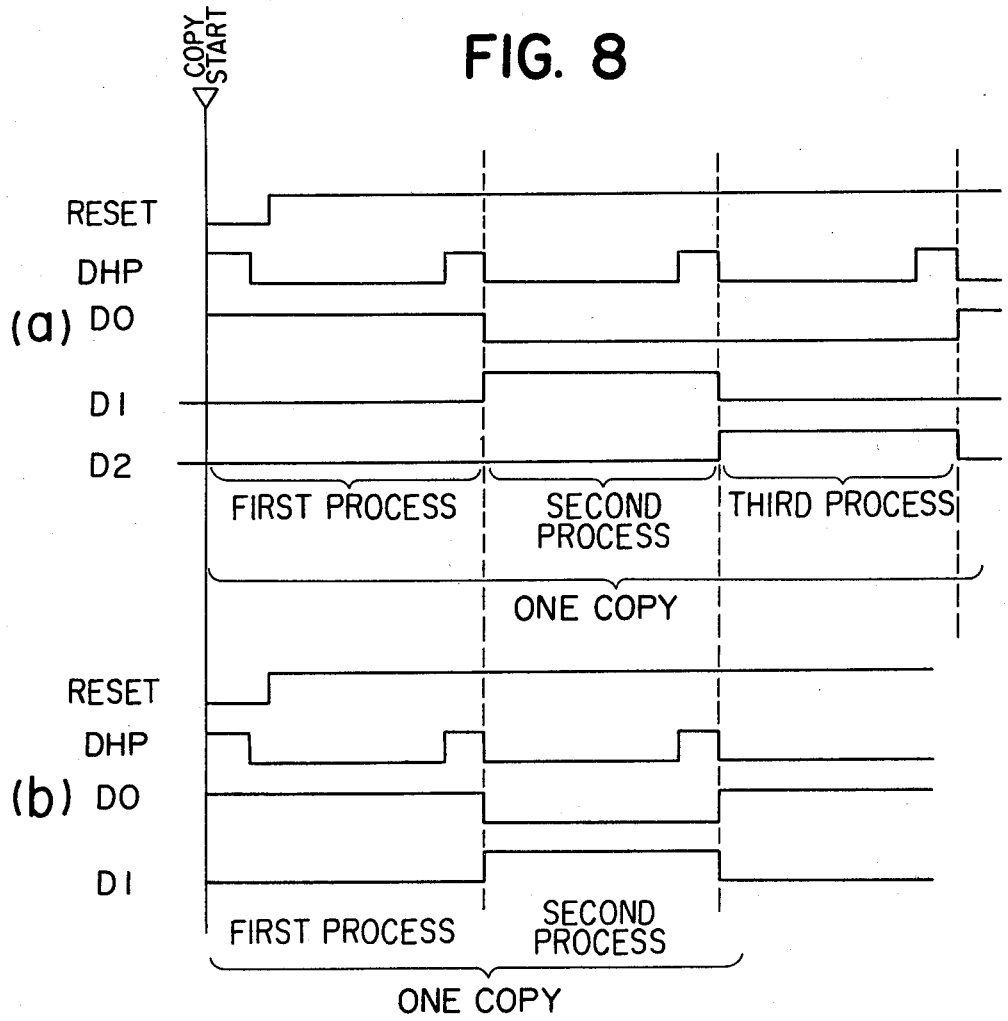
FIG. 8 is a time chart for illustrating the control sequence of the FIG. 7 circuit.

Operations resulting from selection of each switch will now be described in connection with the time chart of FIG. 8.

Full Color Copying (COLOR Switches):

Upon closing of the copy start switch, the copying is started and at the same time, the counter CNT is cleared by a reset signal RESET so that the output signal $D_O$ of the decoder DEC assumes H-level. By this rising of the signal $D_O$, the gate $A_1$ is opened so that the output signals of the gates $F_1$ and $E_1$ for driving the blue filter B and yellow developing unit Y connected to the gate $A_1$ are caused to assume H-level.

Thus, the first image formation is effected by the photosensitive medium being exposed to the light from the original through the blue filter and then developed by the yellow developing unit. The image so developed is then transferred onto a transfer medium. Subsequently, the home position signal DHP provides the clock input for the counter CNT, which thus counts up one, whereupon the signal $D_O$ assumes L-level while the signal $D_1$ assumes H-level. By this, the gate $A_2$ is opened so that the output signal of the gates $F_2$ and $E_2$ for driving the green filter 9 and magenta developing unit M connected to the gate $A_2$ are caused to assume H-level and thus, the second image formation is accomplished by the photosensitive medium being exposed to the image light from the original through the green filter G and then developed by the magneta developing unit. Likewise, upon arrival of the subsequent home position signal DHP, the counter CNT further counts up one, whereupon the output signal $D_2$ of the decoder DEC assumes H-level. By this, the gate $A_3$ is opened so that the output signals of the gates $F_3$ and $E_3$ are caused to assume H-level and thus, the third image formation is accomplished by the photosensitive medium being exposed to the image light from the original through the red filter R and then developed by the cyan developing unit.

These developed images are superposedly transferred onto the transfer medium to provide a color copy.

Upon arrival of a further home position signal DHP at the counter CNT, which has so far performed as a trinary counter, this counter is reset to its initial position and if copying is to be further continued, the above-described process may be repeated, but if there is no subsequent process to occur, the copy finish process will be entered. Needless to say, the color copy previously formed is separated from the transfer drum or the like and transported to the fixing device.

BK-M Copying:

Unlike the case of full color copying, the image formation process takes place twice, namely, once for BK copying and once for M copying. Upon copy start, the counter CNT is cleared by the reset signal RESET and the output signal $D_O$ of the decoder DEC assumes H-level.

Upon setting of the BK-M switch and by the output signal $D_O$, the gate $A_4$ is opened so that the gates $F_2$ and $E_2$ for driving the green filter G and magenta developing unit M connected to the gate $A_4$ are caused to assume H-level. Thus, the first image formation is accomplished by the photosensitive medium being exposed to the original image through the green filter and then developed by the magenta developing unit.

Subsequently, upon arrival of the home position signal DHP, the counter CNT counts up so that the output signal $D_1$ of the decoder DEC assumes H-level. By this, the gate $A_5$ is opened so that the gates $F_3$ and $E_4$ for driving the red filter R and black developing unit BK are caused to assume H-level and thus, the second image formation is accomplished by the photosensitive medium being exposed to the original image through the red filter R and then developed by the black developing unit. The images so developed are successively transferred onto a transfer medium, and upon arrival of the subsequent home position signal DHP, the transfer medium enters the steps of separation and fixation but if the copying is to be continued, the initial step is restored to repeat the above-described process until a predetermined number of copies are finished. In other words, the counter CNT which has so far performed as a binary counter is reset by the arrival of the signal DHP to restore its initial position.

R, G, B Copying:

This mode of copying which uses a mixture of two colors from among cyan, magenta and yellow developers is similar to the BK-M copying in that image formation is effected two times, but differs from the BK-M copying in construction and operation of the gates inasmuch as the ND filter is used at all times. For example, when the switch R is closed to start copying to provide a red copy, the counter CNT is cleared by the reset signal RESET so that the output signal $D_O$ of the decoder DEC is caused to assume H-level and thereby open the gate $A_6$, whereby the gate $E_1$ for driving the yellow developing unit Y connected to the gate $A_6$ is caused to assume H-level.

On the other hand, the gate $F_4$ for selecting the ND filter is connected to the gate $A_{16}$ but this gate $A_{16}$ is normally opened by closing of the switch R, so that in spite of the repeated image formation, the gate $F_4$ is maintained at H-level to ensure the ND filter to be set during the image formation.

Therefore, the first image formation is effected by the exposure to the image original through the ND filter and by the yellow development, and the developed image is transferred onto a transfer medium.

Subsequently, upon arrival of the home position signal DHP at the counter CNT, this counter counts up one and the output $D_1$ of the decoder DEC assumes high level, so that the gate $A_7$ is opened and the gate $E_2$ for driving the magenta developing unit connected to the gate $A_7$ assumes H-level. On the other hand, the ND filter is set as already noted. Therefore, the second image formation is accomplished by the exposure to the image original through the ND filter and by the magenta development, whereafter the magenta image is superposed upon the yellow image on the transfer medium. The subsequent operation of the counter is similar to what has been already described in connection with the BK-M copying.

Y, M, C, BK Copying:

In these copying modes, reproduction of each color requires only one image formation process to provide a complete copy and thus, the counting and control by the counter CNT is not necessary, but a predetermined color developing unit and ND filter are selected and driven in accordance directly with the mode switch selected. For example, when Y switch is closed, the gate $E_1$ for driving the yellow developing unit Y is opened and the gate $A_{21}$ is opened and the gate $F_4$ for driving the ND filter connected to the gate $A_{21}$ is also opened. Thus, upon copy start, the photosensitive medium is exposed to the image original through the ND filter and then developed by the yellow developer, thereby enabling reproduction of a yellow image.

In the manner as described above, a predetermined color developer and a filter are combination-controlled in accordance with each copying mode to thereby realize good color image formation. In the above-described embodiment, the sequence of colors to be reproduced for multicolor reproduction can be suitably selected and this is suitable for good color reproduction.

(II) Color Programming Switches

The color programming switches shown in FIG. 4 are not restricted to the copy modes often used with the previously shown copy mode switches, but permit any desired combination of filter and developer and any desired number of colors to be selected.

The use of these switches enables realization of the following special copying operations in addition to the copying modes described under item (I) above, and this may widen the usage of the copying apparatus for use by professional designers or cameramen.

(1) From a colored original, color copies differing in color arrangement from the original may be obtained. For example, if an original written in yellow and red is copied by effecting the exposure to the image original through the blue filter and the cyan development and the exposure to the image original through the green filter and the yellow development, the yellow and red of the original may be changed into cyan and green, respectively. Such usage will be highly effective for fashion or interior designers to examine the effect of color arrangement.

(2) Copies in which some part of an original is erased may be obtained. For example, where a document written in black and having red entries is to be copied with the red entries erased, the exposure to the original may be effected through the red filter in combination with the black development, thereby producing a copy in which the red portion has been erased and the black portion alone is retained. Such usage will be very effective for office work.

(3) Copies with high contrast can be produced from an original bearing color images which it is difficult to reproduce by the ordinary black-and-white copying apparatus. For example, yellow prints or the blue of no-carbon paper is difficult to clearly reproduce by the use of the ordinary black-and-white copying apparatus, but such a yellow image original may be well copied by effecting the exposure to the yellow image through the blue filter to provide a latent image with high contrast and by developing the latent image by the use of black or other suitable color developer. The blue of no-carbon paper may be reproduced into a cyan copy image by effecting the exposure to the original through the red filter and by cyan-developing the resultant latent image.

As shown above by way of example, the special usages are very much complicated and various and therefore, the programming switches as shown in FIG. 4 which may be set in accordance with any desired one of the usages are highly effective.

Figure 10:
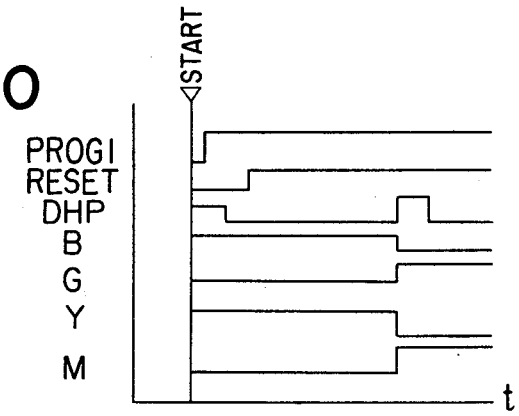
FIG. 10 is a time chart for illustrating the control sequence of the FIG. 9 circuit.
Figure 9:
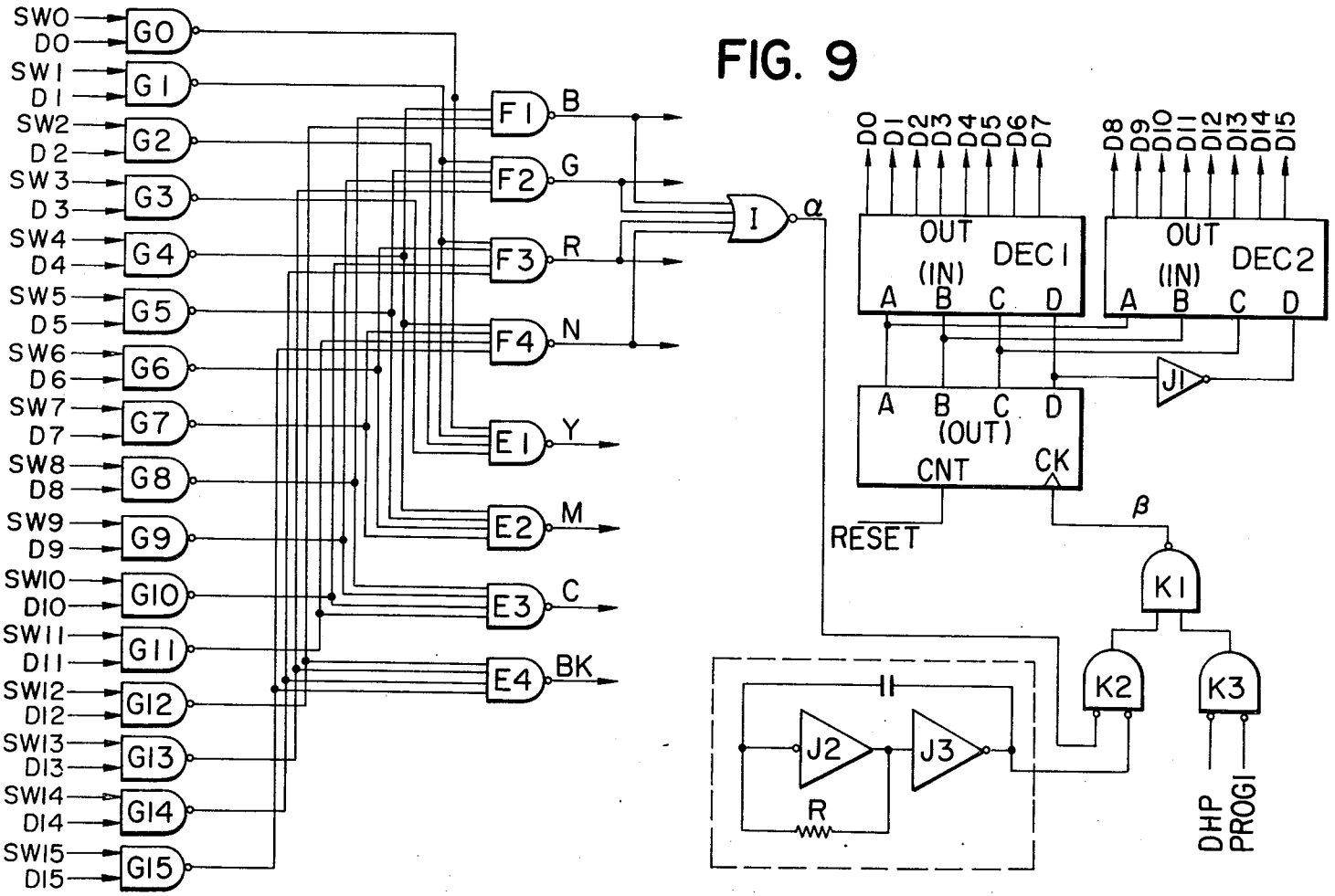
FIG. 9 diagrammatically shows an example of the control circuit based on the switches shown in FIG. 4.

FIG. 9 shows an example of the control circuit for the programming switches shown in FIG. 4, and FIG. 10 is a time chart illustrating an example of the control effected thereby. Description will hereinafter be made by reference to these Figures.

The group of switches shown in FIG. 4 is used to set combinations of filters and developing units. When there are four types of development, namely, Y (yellow development), M (magenta development), C (cyan development) and BK (black development) and four types of filter, namely, B (blue filter), G (green filter), R (red filter) and ND (ND filter), there are sixteen combinations between filters and developing units and these correspond to $SW_0$–$SW_{15}$. For example, where an original is to be reproduced in three full colors, the possible combinations between filters and developing units are: filter B—developing unit Y; filter G—developing unit M; and filter R—developing unit C; and one of these combinations may be selected by closing of the setting switch $SW_0$, $SW_5$ or $SW_{10}$.

The circuit of FIG. 9 is for successively changing over the combinations of filters and developing units set by the above-described switches, in synchronism with the copying process. In this circuit, gates $G_0$–$G_{15}$ have their inputs connected to the swtiches $SW_0$–$SW_{15}$ and have their outputs connected to the gates $F_1$–$F_4$ and $E_1$–$E_4$ for ultimately determining the combinations of filters and developing units. The counter CNT serves to count the pulse from a well-known oscillator OSC and put out signals $D_0$–$D_{15}$ through decoders $DEC_1$ and $DEC_2$, and starts to count upon arrival of the drum home position signal DHP from the transfer drum or the like through gates $K_1$ and $K_3$. Signals $D_0$–$D_{15}$ serve to scan the gates $G_0$–$G_{15}$ to produce signals B, G, R, ND, Y, M, C and BK for driving the filters and developing units. Gate I is provided to block the output of the oscillator OSC through the gate $K_2$. The pulse from the oscillator OSC is of much shorter interval than DHP.

Signals PROGI, RESET, DHP, B, G, Y and M after copy start may be shown as in the time chart of FIG. 10. PROGI is a signal which assumes H-level during the time of exposure to the image original (including the time required from the light source to return to its home position) and assumes L-level during the idle per-rotation of the drum for the recovery of the characteristic of the photosensitive medium, during the idle post-rotation for the cleaning or other after-treatment of the photosensitive medium and during the stoppage of the drum.

RESET is a signal which assumes H-level in a certain time after the PROGI signal has assumed H-level and assumes L-level as soon as the PROGI signal assumes L-level, and serves to reset a hexadecimal counter CNT by its L-level. DHP is a signal which assumes H-level when the transfer drum is in its home position and assumes L-level during the other times. Signals B, G and Y, M are the output signals of gates E and F provided in the manner described below, and when they assume H-level, these signals operate the blue and the green filter and the yellow and the magenta developing unit.

When three-color copying is desired, the signals "H" from the setting switches $SW_0$, $SW_5$ and $SW_{10}$ are applied to the gates $G_0$, $G_5$ and $G_{10}$. Upon depression of the start button, the drum starts to rotate but under such condition, PROGI is "1", RESET is "0" and DHP is "1", so that the counter CNT maintains its reset position and the output of the decoders $DEC_1$ and $DEC_2$ assume H-level only at $D_0$ terminals. Thus, at the gate $G_1$, the input $SW_0$ assumes H-level and $D_0$ assumes H-level, so that the output B of the gate $F_1$ assumes H-level and accordingly, the output $\alpha$ of the gate I assumes L-level. Due to this, the output $\beta$ of the gate $K_1$ assumes L-level and therefore, the counter CNT remains inoperative. Also, since the output Y of the gate $F_1$ and the output B of the gate $E_1$ are both at H-level, the blue filter and the yellow developing unit are operated thereby. The drum is thus rotated, whereby the separated blue image of the original is thrown upon the drum and yellow-developed thereon. Upon arrival of the subsequent DHP signal, $\beta$ momentarily assumes H-level to advance the counter CNT by one step. By this, $D_1$ is caused to assume H-level while the other signals assume L-level. Under such condition, $SW_1$ is at L-level so that the output of the gate $B_1$ assumes H-level and thus, the counter is not stopped. Accordingly, the counter continues to count stepwise in accordance with the pulse from the oscillator OSC and when the output $D_5$ of the decode assumes H-level, $SW_5$ is at H-level so that the output of the gate $B_5$ is rendered to L-level to render $\alpha$ to L-level, thus stopping the counter. Simultaneously therewith, the outputs of the gates $F_2$ and $E_2$ provide the signals for operating the green filter and the magenta developing unit. Likewise, by the subsequent DHP signal, the counter CNT is started to count stepwise and continues it with the aid of the pulse from the oscillator OSC until the output $D_{10}$ of the decoder assumes H-level. When the counter CNT comes to halt, the red filter and the cyan developing unit are now operated by the outputs of the gates $F_3$ and $E_3$.

Now, in case of two-color copying, and for example, where the original is written in red and black, the red and black may be approximately reproduced if magenta development and black development occur with the use of the green filter and the red filter, respectively, upon closing of the switches $SW_5$ and $SW_{14}$. First, depression of the start switch starts the output $D_0$ from H-level, but since $\alpha$ is at H-level, the counter CNT continues to count the pulse from the oscillator OSC until $D_5$ assumes H-level, whereupon the counter is stopped. Under such condition, the signal G is at H-level and the signal M is also at H-level, thereby operating the green filter and the magenta developing unit. As the drum continues to rotate to generate the subsequent DHP pulse, $D_5$ and $D_6$ assumes L- and H-level, respectively. Thus, the counter CNT resumes its stepwise count and continues it until $D_{14}$ assumes H-level, whereupon the counter is stopped. Under such condition, the signal R is at H-level and the signal BK is also at H-level, thereby operating the red filter and the black developing unit.

As will be apparent from what has hitherto been described, there is provided an automatic color selector in a copying machine of the multicolor superposition type wherein the combinations preset by switches for setting combinations of filters and developing units are automatically changed over in synchronism with the drum by a change-over device comprising an oscillator and a counter, whereby any desired combinations may be achieved in succession.

Description has been made with respect to the case where snap switches are used, whereas it is also within the scope of the present invention to use no-contact switches functionally similar to the snap switches and the number of the switches is not limited to sixteen. Further, the DHP signal may be taken out from any equivalent point which will provide the reference, such as the transfer drum, the photosensitive drum, the moving optical system or the like.

(III) Copy Color Balance Switches

The copy color balance switches shown in FIG. 5 can selectively set not only the combinations of filters and developing units but also the reproducing color densities.

The numbers 1, 2 and 3 seen at the left-hand portion of FIG. 5 indicate the sequence of the image formations and mean that the superposition transfer is possible up to maximum three times.

The push button switches include the switches for selecting the filters B, G, R and ND, the switches for selecting the developing units, Y, M, C and BK to be combined with those filters, and an OFF switch for stopping the development.

The right-hand group of switches are for setting the factors of the primary charging and the simultaneous application of image light and AC discharge when the filters, B, G, R and ND are used. In this group, the left switches are for use when a strong density is required for the copy image, the middle ones are for use when an intermediate density is required for the copy image, and the right ones are for use when a weak density is required for the copy image.

Figure 11:
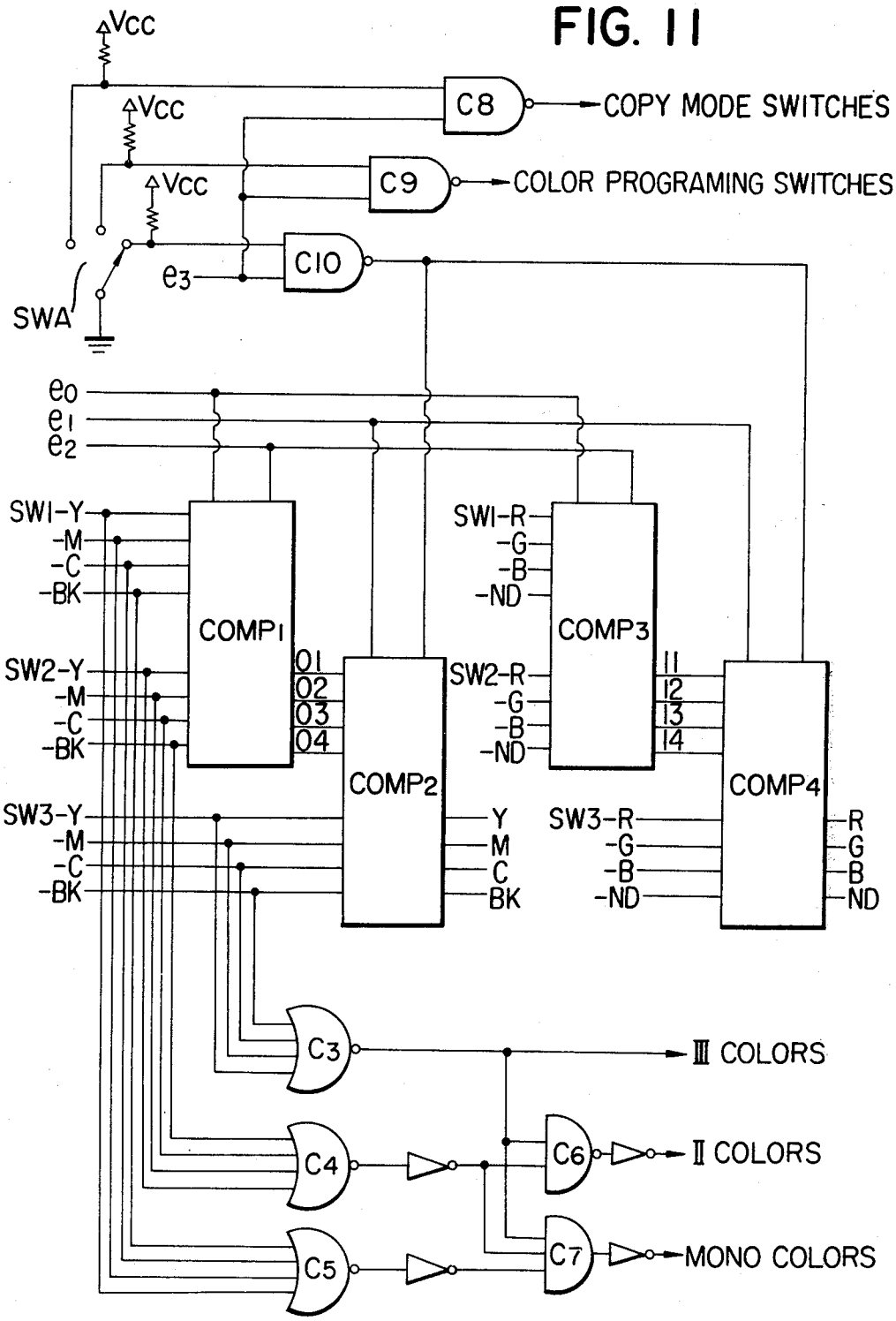
FIGS. 11 and 12 are partial diagrams of the control circuit based on the switches shown in FIG. 5.

FIG. 11 shows an embodiment of the control circuit for the left switch group of the color balance switches shown in FIG. 5.

Switches SW1-Y, -M, -C and -BK serve to designate the developing colors in the first reproducing process, and switches SW1-R, -G, -B and -ND serve to designate the filter colors in the first reproducing process. Likewise, switches SW2 serve similar purposes in the second reproducing process, and switches SW3 serve similar purposes in the third reproducing process.

Thus, it is possible to select sixteen combinations of filters and developing units in each reproducing process and also to arbitrarily select the sequence in which the developing colors are to be used during the first to the third reproducing process, and this means the possibility also of the other desired color reproductions than those in which the sequence of colors is fixed by the color reproducing switches of FIG. 4. The colors set by each switch group may be carried out in a predetermined sequence of reproducing processes by comparators IC ($COMP_1, \ldots, COMP_4$). More specifically, the sequence of the reproducing process is determined by a combination of signals $l_0$, $l_1$ and $l_2$ which controls the outputs of the comparators IC ($COMP_1, \ldots, COMP_4$). For example, if $l_0$ and $l_1$ are set to H-level and $l_2$ to L-level, the outputs of the switch SW1 group appear at the output terminals of the comparator $COMP_1$ and the outputs of the comparator $COMP_1$ in turn appear at the output terminals of the comparator $COMP_2$. Thus, the color developing units selected by the group of switches SW1-C, -M, -Y and -BK are driven. The outputs of the comparators $COMP_3$ and $COMP_4$ are likewise put out, so that the filters selected by the group of switches SW1-R, -G, -B and -ND are driven. Subsequently, in the second reproducing process, $l_0$ assumes L-level and $l_1$ and $l_2$ assume H-level, so that there is provided a combination of the color developers and filters selected by the group of switches SW2. In the third reproducing process, $l_1$ assumes L-level and $l_2$ and $l_0$ assume H-level, so that there is provided a combination of the color developers and filters selected by the group of switches SW3.

Gates $C_3$ to $C_7$ for a circuit for setting the number of colors to be reproduced. Gates $C_8$ to $C_{10}$ are for changing over the groups of operating switches such as copy mode switches, color programming switches and color balance switches. By a change-over switch SWA being set to its shown position, the output of the gate $C_{10}$ assumes L-level so as to render the above-described color balance switch group usable. The input signal $l_3$ to the gate $C_{10}$ is for controlling the timing of the exposure and development.

Figure 12:
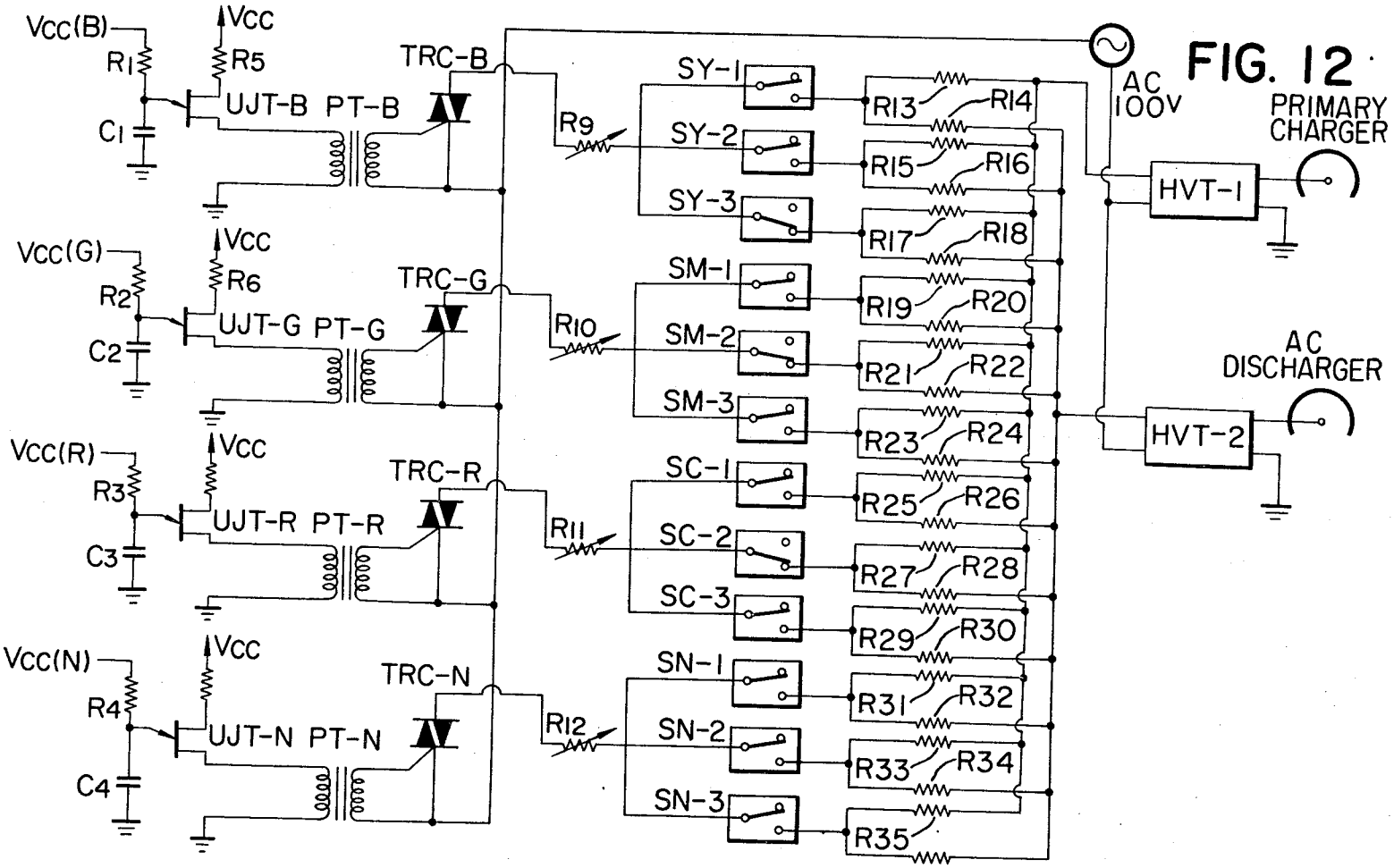

FIG. 12 shows an embodiment of the high voltage source control circuit settable by the color balance switches of FIG. 5.

The filter selecting signals from the gates $F_1$–$F_4$ are also supplied to $V_{cc}(B)$–$V_{cc}(N)$ in FIG. 12 to provide signals for driving the high voltage source.

In FIG. 12, switches $S_{Y\text{-}1}$–$S_{Y\text{-}3}$, $S_{M\text{-}1}$–$S_{M\text{-}3}$, $S_{C\text{-}1}$–$S_{C\text{-}3}$ and $S_{N\text{-}1}$–$S_{N\text{-}3}$ correspond to the image density setting switches seen on the right-hand side of FIG. 5. The high voltage source control circuit of FIG. 12 serves to set the voltages produced by the high voltage sources HVT-1 and HVT-2 for the primary charger and the AC discharger, in accordance with selected ones of the switches $S_{Y\text{-}1}$–$S_{N\text{-}3}$, and control the density of the resultant copy image.

For example, in the process for effecting the yellow development, application of the voltage to $V_{cc}(B)$ causes a unijunction transistor UJT-B to start oscillating through resistor $R_1$. A triac TRC-B is rendered conductive through a pulse transformer PT-B, so that predetermined current flows to the primary side of the high voltage source HVT-1 for the primary charger through resistor $R_9$, programming switch $S_{Y\text{-}3}$ and resistor $R_{17}$ and to the primary side of the AC voltage source HVT-2 for the discharger through resistor $R_9$, programming switch $S_{Y\text{-}3}$ and resistor $R_{18}$, thereby producing a necessary high voltage for the yellow developing process.

In this manner, the conditions for any desired image reproduction may be programmed.

As described above in detail, the apparatus of the present embodiment permits desired combinations of filters and developing units and includes various operating switches for setting desired densities, thereby enabling formation of a great variety of color images.

The invention is not restricted to the illustrated embodiment but may of course be variously modified without departing the spirit of the invention.

In the above-described embodiment, three groups of switches, namely, copy mode switches, color programming switches and color balance switches, are provided, but a combination of two of these three switch groups would also be very effective in practice.

Further, the number of switches in each group is not restricted to that shown in the illustrated embodiment, of course.

Thus, the apparatus according to the present invention can achieve a great variety of color reproductions, not only full color reproduction but also desired color reproduction of desired color-separated images and color image reproduction in desired color arrangements.

Accordingly, the apparatus of the present invention will find wide uses not only in the reproduction of clerical copies but also in the advertisement designs, industrial designs, etc.

What we claim is:

1. A color image forming apparatus which projects an optical image, having light components of an image original, upon a photosensitive medium for forming electrostatic latent images thereon, and which color-develops the latent images to form a color image, said apparatus comprising a photosensitive medium, optical image projecting means for exposing said photosensitive medium to the optical image, electrostatic latent image formation means for forming electrostatic latent images on said photosensitive medium in accordance with the exposure to the optical image effected by said optical image projecting means, color separating means having a plurality of color separating filters for selective disposition in the optical path of said optical image projecting means, developing means having a plurality of developing units for supplying different color developers to develop the electrostatic latent images formed on said photosensitive medium by said electrostatic latent image formation means, a plurality of process mode setting means each having a first element for setting a selected one of said color separating filters across the optical path, and a second element for setting a corresponding selected one of said developing units to be operated, wherein two of said process mode setting means may be identically set and control means coupled with each of said process mode setting means, for actuating said separating filters and said developing means in a predetermined order and in accordance with the settings of said first and second elements.

2. A color image forming apparatus as set forth in claim 1 wherein said plurality of process mode setting means comprises three pairs of said first and second elements, and wherein each of said elements comprises a multi-position switch means for selecting, respectively, any one of said color separating filters, and any one of said color developing units.

3. A color image forming apparatus as set forth in claim 2 wherein said control means senses the set ones of said multi-position switch means in a predetermined sequence.

4. A color image forming apparatus as set forth in claim 2, further comprising copy mode setting means for selecting all or lesser combinations of said filter means and developer means.

5. A color image forming apparatus as set forth in claim 2, further comprising program mode setting means for setting any selected combination of pairs of respective color separating filters and developing units for cooperating operation.

6. A color image forming apparatus as set forth in claim 2 further comprising image density setting means for setting the desired developed density of the image, wherein said control means is coupled with said image density setting means and said latent image formation means for controlling said image formation means in response to the setting of said image density setting means.

7. A color image forming apparatus as set forth in claim 6, further comprising program mode setting means for setting any selected combination of pairs of respective color separating filters and developing units for cooperating operation.

8. A color image forming apparatus as set forth in claim 7, further comprising copy mode setting means for selecting all or lesser combinations of said filter means and developer means.

9. A color image forming apparatus as set forth in claim 6, wherein said electrostatic latent image formation means includes a charging voltage source the output of which is proportional to the density of image formation, and wherein said control means controls the output of said voltage source in response to the setting of said image density setting means.

10. A color image forming apparatus as set forth in claim 9, further comprising program mode setting means for setting any selected combination of pairs of respective color separating filters and developing units for cooperating operation.

11. A color image forming apparatus as set forth in claim 10, further comprising copy mode setting means for selecting all or lesser combinations of said filter means and developer means.

12. A color image forming apparatus which projects an optical image, having light components of an image original, upon a photosensitive medium for forming electrostatic latent images thereon, and which color-develops the latent images to form a color image, said apparatus comprising a photosensitive medium, optical image projecting means for exposing said photosensitive medium to the optical image, electrostatic latent image formation means for forming electrostatic latent images on said photosensitive medium in accordance with the exposure to the optical image effected by said optical image projecting means, color separating means having a plurality of color separating filters for selective disposition in the optical path of said optical image projecting means, developing means having a plurality of developing units for supplying different color developers to develop the electrostatic latent images formed on said photosensitive medium by said electrostatic latent image formation means, a plurality of process mode setting means each having a first element for setting a selected one of said color separating filters across the optical path, and a second element for setting a corresponding selected one of said developing units to be operated, wherein two of said process mode setting means may be identically set, a plurality of image density setting means for setting the desired developed density of the image corresponding to said process mode setting means and control means coupled with each of said process mode and image density setting means, for actuating said separating filters and said developing means in a predetermined order and in accordance with the settings of said first and second elements, wherein said control means is coupled also to control said latent image formation means in response to the setting of said image density setting means.

13. A color image forming apparatus as set forth in claim 12, further comprising copy mode setting means for selecting all or lesser combinations of said filter means and developer means.

14. A color image forming apparatus as set forth in claim 12, wherein said electrostatic latent image formation means includes a charging voltage source the output of which is proportional to the density of image formation, and wherein said control means controls the output of said voltage source in response to the setting of said image density setting means.

15. A color image forming apparatus as set forth in claim 14, further comprising program mode setting means for setting any selected combination of pairs of respective color separating filters and developing units for cooperating operation.

16. A color image forming apparatus as set forth in claim 15, further comprising copy mode setting means for selecting all or lesser combinations of said filter means and developer means.

17. A color image forming apparatus as set forth in claim 12, further comprising program mode setting means for setting any selected combination of pairs of respective color separating filters and developing units for cooperating operation.

18. A color image forming apparatus as set forth in claim 17, further comprising copy mode setting means for selecting all or lesser combinations of said filter means and developer means.

19. A color image forming apparatus which projects an optical image, having light components of an image original, upon a photosensitive medium for forming electrostatic latent images thereon, and which color-develops the latent images to form a color image, said apparatus comprising a photosensitive medium, optical image projecting means for exposing said photosensitive medium to the optical image, electrostatic latent image formation means for forming electrostatic latent images on said photosensitive medium in accordance with the exposure to the optical image effected by said optical image projecting means, color separating means having a plurality of color separating filters for selective disposition in the optical path of said optical image projecting means, developing means having a plurality of developing units for supplying different color developers to develop the electrostatic latent images formed on said photosensitive medium by said electrostatic latent image formation means, a plurality of process mode setting means each having a first element for setting a selected one of said color separating filters across the optical path, and a second element for setting a corresponding selected one of said developing units to be operated, wherein two of said process mode setting means may be identically set, program mode setting means for setting any selected combination of pairs of respective color separating filters and developing units for cooperating operation and control means coupled with each of said process mode setting means, for actuating said separating filters and said developing means in a predetermined order and in accordance with the settings of said first and second elements.

20. A color image forming apparatus as set forth in claim 19, further comprising copy mode setting means for selecting all or lesser combinations of said filter means and developer means.

21. A color image forming apparatus which projects an optical image, having light components of an image original, upon a photosensitive medium for forming electrostatic latent images thereon, and which color-develops the latent images to form a color image, said apparatus comprising a photosensitive medium, optical image projecting means for exposing said photosensitive medium to the optical image, electrostatic latent image formation means for forming electrostatic latent images on said photosensitive medium in accordance with the exposure to the optical image effected by said optical image projecting means, color separating means having a plurality of color separating filters for selective disposition in the optical path of said optical image projecting means, developing means having a plurality of developing units for supplying different color developers to develop the electrostatic latent images formed on said photosensitive medium by said electrostatic latent image formation means, a plurality of process mode setting means each having a first element for setting a selected one of said color separating filters across the optical path, and a second element for setting a corresponding selected one of said developing units to be operated, wherein two of said process mode setting means may be identically set, copy mode setting means for selecting more than a single combination of said filter means and developer means, and a control means coupled with each of said process mode and copy mode setting means, for actuating said separating filters and said developing means in a predetermined order and in accordance with the settings of said first and second elements.

* * * * *